US012128472B2

(12) United States Patent
Zaffaroni et al.

(10) Patent No.: US 12,128,472 B2
(45) Date of Patent: Oct. 29, 2024

(54) EMBOSSING ROLL

(71) Applicant: HYDRO EXTRUDED SOLUTIONS AS, Oslo (NO)

(72) Inventors: Giorgio Giovanni Battista Zaffaroni, Tradate (IT); Marco Pasqualon, Bierges (BE); Andrej Mangelsdorf, Cologne (DE)

(73) Assignee: HYDRO EXTRUDED SOLUTIONS AS, Oslo (NO)

( * ) Notice: Subject to any disclaimer, the term of this patent is extended or adjusted under 35 U.S.C. 154(b) by 0 days.

(21) Appl. No.: 18/010,292

(22) PCT Filed: Jun. 10, 2021

(86) PCT No.: PCT/EP2021/065673
§ 371 (c)(1),
(2) Date: Dec. 14, 2022

(87) PCT Pub. No.: WO2021/254882
PCT Pub. Date: Dec. 23, 2021

(65) Prior Publication Data

US 2023/0271244 A1 Aug. 31, 2023

(30) Foreign Application Priority Data

Jun. 15, 2020 (SE) ..... 2050713-3

(51) Int. Cl.
*B21H 8/00* (2006.01)

(52) U.S. Cl.
CPC ..... *B21H 8/005* (2013.01)

(58) Field of Classification Search
CPC ..... B21H 8/005
USPC ..... 492/30, 33, 34
See application file for complete search history.

(56) References Cited

U.S. PATENT DOCUMENTS 133,454 A * 11/1872 Kellogg ..... B21B 27/035 492/34
3,073,690 A * 1/1963 Hollis ..... B24B 19/028 451/142
3,545,394 A * 12/1970 Shive ..... F28F 1/14 29/890.042
3,690,140 A * 9/1972 Shive ..... B21D 53/04 29/890.042

(Continued)

FOREIGN PATENT DOCUMENTS

| | | |
|---|---|---|
| EP | 0 603 108 | 6/1994 |
| EP | 1 219 377 | 7/2002 |
| JP | 11-104712 | 4/1999 |

OTHER PUBLICATIONS

International Search Report and Written Opinion of the International Searching Authority issued Sep. 27, 2021, in International (PCT) Application No. PCT/EP2021/065673.

*Primary Examiner* — Jason L Vaughan
(74) *Attorney, Agent, or Firm* — Wenderoth, Lind & Ponack, L.L.P.

(57) ABSTRACT

An embossing roll (1) having a cylindrical surface (2) comprising a central portion (3) having an embossing pattern (10) and side portions (4*a*, 4*b*) arranged on each side of the central portion, which are free from embossing pattern, wherein circumferential buffer channels (5) are provided on each side of the central portion (3), between the central portion and the side portions, along the cylindrical surface (2) of the embossing roll.

14 Claims, 3 Drawing Sheets

(56) References Cited

U.S. PATENT DOCUMENTS 3,831,675 A * 8/1974 McLain ..... F28F 1/06
228/125
3,858,785 A * 1/1975 McLain ..... B21C 37/083
219/629
3,861,462 A * 1/1975 McLain ..... F28F 1/426
165/DIG. 515
3,885,622 A * 5/1975 McLain ..... F28F 1/42
165/DIG. 515
3,893,795 A * 7/1975 Nauta ..... B44B 5/026
425/363
3,902,552 A * 9/1975 McLain ..... F28F 1/42
138/140
3,906,605 A * 9/1975 McLain ..... F28F 1/42
165/133
3,918,626 A * 11/1975 McLain ..... B21C 37/083
219/67
3,921,883 A * 11/1975 McLain ..... B21C 37/0803
228/151
5,184,674 A * 2/1993 Keyes ..... B21C 37/06
165/184
5,332,034 A * 7/1994 Chiang ..... F28F 1/40
165/184
5,388,329 A 2/1995 Randlett et al.
5,975,196 A * 11/1999 Gaffaney ..... F28F 1/40
165/184
6,883,597 B2 * 4/2005 Thors ..... F28F 1/40
165/184

* cited by examiner

FIG. 1
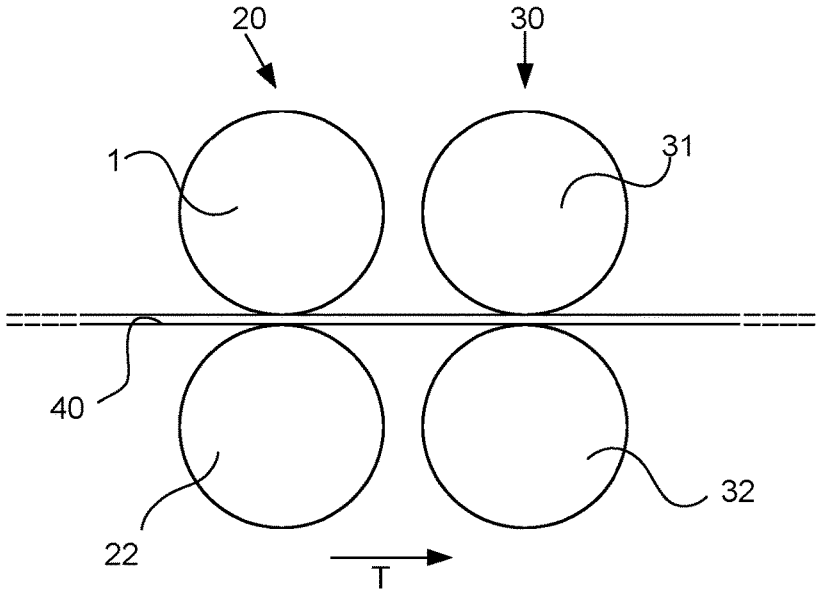
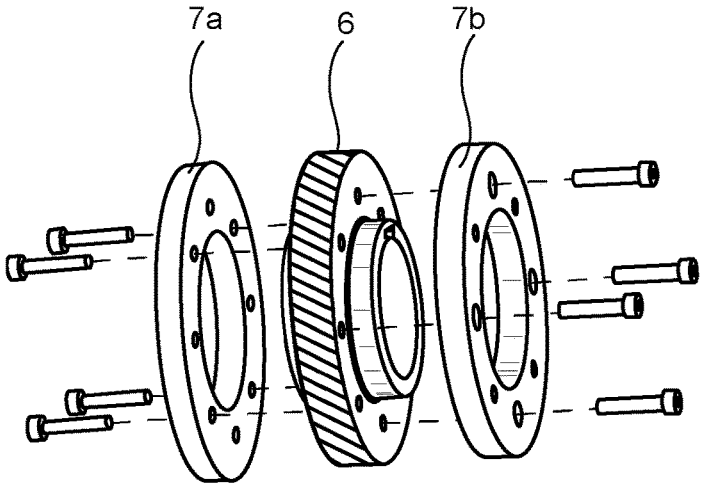
FIG. 2
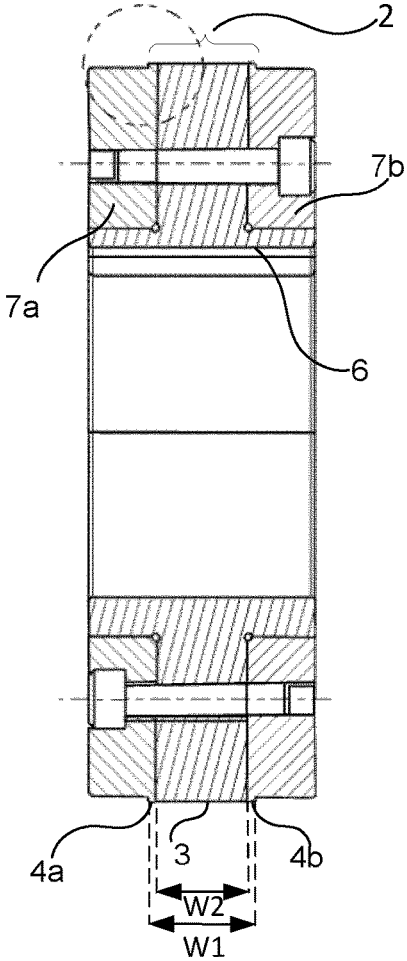
FIG. 3a

EMBOSSING ROLL

TECHNICAL FIELD

The present disclosure relates to an embossing roll suitable for embossing metal strips for use in the manufacture of rolled and welded tubes.

BACKGROUND ART

Welded pipes and tubes are typically manufactured by longitudinally forming flat metal strips into a nearly complete tube and then welding the two edges together. There are many areas of application for roll formed tubing, for example in the field of the HVAC&R market (Heating, Ventilation, Air Conditioning, and Refrigeration). Within this technical field, environmental demands motivate a development toward air conditioning and refrigeration appliances with increased efficiency. In response to this, efforts have been made to supply smaller-diameter tubes with a wide range of inner surface enhancements, able to increase their heat transfer coefficient, in respect to standard smooth solutions. Methods of manufacture of advanced products such as small diameter welded tubes with inner surface patterning for heat exchange applications must result in products with minimal unwanted internal irregularities to obtain optimal flow properties and heat transfer. With increasing demands on cost reduction, there has been an interest in providing an alternative to copper tubing, which has traditionally been dominating for use in air conditioning and refrigeration appliances, in the form of aluminium tubing. It is therefore desirable to find a way to manufacture aluminium tubes with characteristics that are competitive for the purpose of applications such as within the field of HVAC&R.

SUMMARY OF THE INVENTION

The present disclosure relates to an embossing roll by means of which a metal strip can be pre-formed so as to facilitate welding and result in a final tube product with improved weld quality. The embossing roll of the present disclosure has a cylindrical surface comprising a central portion having an embossing pattern and side portions arranged on each side of the central portion. The side portions are free from embossing pattern and circumferential buffer channels are provided on each side of the central portion, between the central portion and the side portions, along the cylindrical surface of the embossing roll. The buffer channel is configured to accommodate material which is being displaced sideways due to the impression of the embossing pattern, and thereby resulting in a pre-formed strip which has an embossed surface pattern and improved straightness at the outer longitudinal edges.

The embossing pattern on the central portion of the embossing roll preferably comprises a plurality of elongated grooves having a certain depth and being arranged at an angle with respect to the direction of rotation of the embossing roll. The groove depth of the embossing pattern is preferably below 0.35 mm.

The central portion of the embossing roll may be comprised of a central embossing pattern roll pack, and the side portions may be comprised of side rolls. The side rolls are then arranged on each side of the central embossing roll pack, and the central embossing pattern roll pack has a cylindrical surface forming the central portion of the embossing roll and the side rolls have cylindrical surfaces forming the side portions of the embossing roll. In this way flexibility as to the embossing pattern is obtained. The cylindrical surfaces of the central embossing pattern roll pack and the side rolls can have bevelled edges at the interface between the central embossing pattern roll pack and the side rolls, so that the circumferential buffer channels are formed at said interface by the bevelled edges of the central embossing pattern roll pack and the bevelled edges of the side rolls, which allows for a convenient way to obtain the buffer channels.

Advantageously, the circumferential buffer channels formed by the bevelled edges of the central embossing pattern roll pack and the bevelled edges of the side rolls have a depth, which is less than the depth of the embossing pattern grooves, preferably 50-70% of the depth of the embossing pattern grooves. Thereby, the buffer channel can accommodate displaced material without adversely affecting the flow properties of the finished tube product.

The cylindrical surface of the embossing roll may suitably have a total width of 15 mm or more, and the central portion has a width, which is 85-99% of the total width, to suitably allow pre-forming of a strip for the manufacture of heat exchanger tubes for HVAC&R applications.

The central portion of the embossing roll may comprise an embossing pattern roll pack including one or more embossing pattern discs with cylindrical embossing surfaces having the same or different embossing pattern provided thereon, so as to allow flexibility in the choice of embossing pattern. The embossing pattern roll pack may further comprise a smooth spacer ring between each embossing pattern disc, the cylindrical surface of each spacer ring being level with the cylindrical surface of the central portion between the grooves. This allows for further flexibility in the embossing pattern.

The embossing pattern discs and the optionally included smooth spacer ring, preferably have bevelled edges at the interface between them. This minimises locally stress in the material, and thus decreases the risk that the tool breaks.

The embossing pattern on the central portion of the embossing roll preferably comprises a plurality of grooves arranged in the cylindrical surface of the central portion, and the cylindrical surface of each side portion is suitably level with the cylindrical surface of the central portion between the grooves, in order to facilitate the subsequent welding process.

BRIEF DESCRIPTION OF THE DRAWINGS

FIG. 1 is a schematic illustration of a preforming set-up;

FIG. 2 is an exploded perspective view of an example of an embossing roll according to the present disclosure;

FIG. 3*a* is a cross-sectional view of the embossing roll of FIG. 2;

DETAILED DESCRIPTION

Figure 3B:
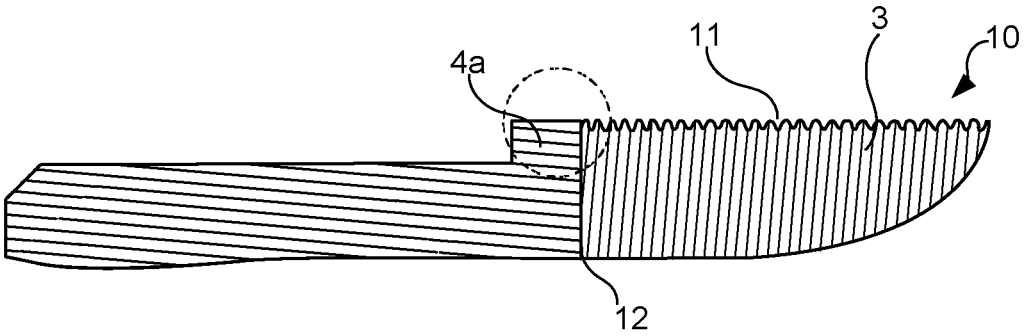
FIG. 3*b* is a cross-sectional view of the encircled detail shown in FIG. 3*a;*

The present disclosure relates to an embossing roll for use in a tool for pre-forming metal strips for the manufacture of tubes. The embossing roll has a cylindrical surface comprising a central portion having an embossing pattern and side portions arranged on each side of the central portion. The side portions are free from embossing pattern. Circumferential buffer channels are provided on each side of the central portion, between the central portion and the side portion, along the cylindrical surface of the embossing roll. By means of the present embossing roll, a metal strip can be pre-formed so as to facilitate welding and result in a final tube product with improved weld quality.

The final products may suitably be advanced small diameter tube products made of aluminium or alloys thereof, having a diameter of 20 mm or less, preferably 5-10 mm. The tube products are preferably manufactured as continuous tube coils having a length of over 500 m, preferably over 1000 m. Such tube products find use for example within the field of heating, ventilation, air conditioning or refrigeration.

The process of welded tube roll forming involves roll forming a pre-formed strip into a tubular shape and welding the longitudinal edges of the strip together so as to obtain the tube by means of high frequency welding in an induction heating weld coil. To achieve this, the strip is fed into a forming mill or apparatus that shapes the strip through different consecutive forming steps, performed by as many forming rolls. As the strip passes through the weld coil, an electromagnetic field is induced around the weld coil, which induces a current to flow in the strip, mostly concentrated at the edges to be joined. The metals resistance to the electricity flow generates the necessary heat development at these edges, that rapidly reach the melting point. When the edges are still in molten state, they are forged together thanks to the interaction with side squeeze rolls, applying force on the strips and, therefore, generating the required pressure at the two edges' interface. When passing through the weld rolls, the oxidized metal and the molten metal are extruded out of the joint and the clean underlying metal is bonded. Following the welding, sizing rolls complete the process, giving desired final geometry to the tube.

Production of advanced tube products such as small diameter welded tubes with inner surface patterning for heat exchange applications from metal strips involves a two-stage process, including the stage of pre-forming the strip, and the stage of roll forming the strip into a tubular shape and welding it into a tube.

In the manufacture of roll formed and welded tube made from aluminium strips, it is important to mitigate problems that may arise due to characteristics of the aluminium material. In order to achieve desired heat transfer properties, the tubes have an interior embossed surface pattern. The variance in strip width should preferably be kept at a minimum to improve stability in the welding process and quality of the finished tube product.

The strip is typically provided in the form of a blank strip coil to the pre-forming stage, in which the strip is prepared to be ready for tube forming and welding in the next stage. The pre-forming stage involves the step of embossing the strip on the surface that will form the inside of the tube, to obtain the embossed pattern that will form the inner grooves of the tube. After the pre-forming stage, the strip can suitably be stored in the form of a coil, until it is to be roll formed and welded in the form of a tube.

The embossing procedure is performed in an embossing station that comprises a cold deformation process performed on strips with the aim of obtaining the surface pattern. The embossing pattern on the central portion of the embossing roll preferably comprises a plurality of elongated grooves having a certain depth and being arranged at an angle with respect to the direction of rotation of the embossing roll. The groove depth of the embossing roll pattern is preferably below 0.35 mm. Various embossing patterns can be applied, for example a helical pattern improves the performance in evaporation applications, and a herringbone pattern improves the performance in condensation applications.

Applying the desired pattern onto the strip surface by embossing is a cold roll-forming process, where the blank strip is fed into a system of coupled rolls, comprising an embossing roll and an anvil roll, applying the necessary forming pressure. The embossing roll has a cylindrical surface comprising a central portion having an embossing pattern and side portions arranged on each side of the central portion. The side portions are free from embossing pattern. The central portion of the embossing roll is provided with a negative of the desired strip pattern, and is pressed onto the strip, which is sustained by the anvil roll, thereby cold roll-forming and embossing the strip. The embossing pattern provided on the embossing roll causes impression of a corresponding embossed pattern on the strip surface, where the grooves of the embossing roll pattern correspond to protruding fins on the strip, so that a pattern of fins is created on the strip surface. The fin height corresponds maximum to the groove depth of the embossing roll pattern.

The strip is suitably de-coiled at a controlled speed before being fed into the embossing station, and after the embossing step it is suitably re-coiled. The anvil roll may be fixed in horizontal position, while the embossing roll may have the freedom to be adjusted in vertical direction, varying the gap between the rolls, thus allowing to tailor and optimally distribute forming pressure on the strip.

The central portion of the embossing roll may be comprised of a central embossing pattern roll pack, and the side portions may be comprised of side rolls, arranged on each side of the central embossing roll pack. The central embossing pattern roll pack has a cylindrical surface forming the central portion of the embossing roll and the side rolls have cylindrical surfaces forming the side portions of the embossing roll. In this way flexibility as to the embossing pattern is obtained. Alternatively, the embossing roll can be made in one piece.

The central embossing pattern roll pack can be comprised of a single embossing pattern disc, or two or more embossing pattern discs with or without spacer discs in between. The embossing pattern discs and the optionally included smooth spacer rings, may preferably have bevelled edges at the interface between them, so that circumferential channels are formed at said interfaces by the bevelled edges. This minimises locally stress in the material, and thus decreases the risk that the tool breaks.

The central embossing pattern roll pack takes care of the pattern formation, and the side rolls serve to provide non-patterned side portions on the strip, described below, by pressing on the outer side portions of the strip. The two side rolls can be bolted to the central embossing ring, which can be clamped to a central shaft and fixed in position in the embossing station.

As mentioned, the side portions of the embossing roll are free from embossing pattern. Thereby, the outer side portions along the cold roll-formed and embossed strip do not present any embossed pattern, but have a smooth surface. By providing these non-patterned side portions along the length of the strip during the pre-forming stage, the risk of variations in the strip edge thickness can be minimized and risk of uneven geometries at the strip edge being presented at welding point can be reduced, and the risk of embossed fins being welded together causing formation of a large inner weld bead can be avoided. Accordingly, the provision of the non-patterned side portions on the embossed strip allows for optimal control of the strip edge geometry, which is essential in ensuring optimal welding conditions, to improve process stability and post-welding tube quality.

The cylindrical surface of the embossing roll may suitably have a total width of 15 mm or more, and the central portion has a width, which is 85-99% of the total width. A strip width of 15 mm or more is suitable for the manufacture of heat exchanger tubes for HVAC&R applications.

The width of the non-patterned side portions is determined based on considerations related to the welding ease and the heat transfer performances of finished tube. Wider non-patterned side portions will be easier to weld, since this will be closer to a standard procedure of smooth strip welding. However, too wide non-patterned side portions may adversely affect the final heat transfer performances, since in the ideal case a continuous pattern all around the inner circumference of the tube would be desired. Accordingly, the width of the non-patterned side portions should preferably be a small as possible, while still ensuring that no embossed fin would have been included in the inner weld bead. It has been found that the combined width of both non-patterned side portions should preferably be 1-15% of the total strip width, when the strip has a total width of 15 mm or more.

The cylindrical surfaces of side portions of the embossing roll are preferably level with the cylindrical surface of the central portion between the grooves of the embossing roll pattern. Thereby it can be ensured that the thickness of the inner weld bead height on a finished welded tube is kept at a minimum. Accordingly, the strip in the area of the non-patterned side portions is preferably rolled down to nominal bottom wall thickness of the tube during the embossing stages, i.e. so as to be level with the bottom of the grooves between the fins of the embossed surface pattern. Therefore, the side portions are kept smooth but are still rolled to a thickness lower than the original one in blank form. This improves the performance of the final tube, since the inner weld bead height can be reduced, resulting in less disturbance to fluid dynamics within the final tube.

The desired thickness of the non-patterned side portions can be obtained by selecting the outer diameter of the embossing roll at the side portions to be the same as the outer diameter of the embossing roll at the central portion.

As mentioned, circumferential buffer channels are advantageously provided on the embossing roll on each side of the central portion, between the central portion and the side portions, along the cylindrical surface of the embossing roll. The buffer channels are configured to accommodate material which is being displaced sideways due to the impression of the embossing pattern in the cold roll-forming and embossing procedure, thereby acting as a material displacement buffer during embossing deformation, reducing the edge geometry waviness, which can otherwise arise due to the irregular geometry of the embossed pattern being impressed by cold deformation into the surface of the strip. Thus, the provision of buffer channels results in a pre-formed strip with improved straightness at the outer edges.

The finished pre-formed strip will typically present a small dimple on the surface, corresponding to the buffer channel. This small dimple may remain in the finished tube, where it constitutes a negligible and acceptable defect.

The buffer channel is a continuous channel (notch) located in the interface between the central portion of the embossing roll and the side portions. The buffer channels can be obtained by carving channels into the embossing roll. Preferably, the buffer channels can be obtained by grinding a corner radius to obtain bevelled edges at the outer edges of the central embossing roll pack and on the side rolls, on the edge adjacent to the central embossing roll pack. Thus, the cylindrical surfaces of the central embossing pattern roll pack and the side rolls can have bevelled edges at the interface between the central embossing pattern roll pack and the side rolls, so that the circumferential buffer channels are formed at said interface by the bevelled edges of the central embossing pattern roll pack and the bevelled edges of the side rolls, which allows for a convenient way to obtain the buffer channels.

Advantageously, the circumferential buffer channels formed by the bevelled edges of the central embossing pattern roll pack and the bevelled edges of the side rolls have a depth, which is less than the depth of the embossing pattern grooves, preferably 50-70% of the depth of the embossing pattern grooves, more preferably 60-65%. Thereby, the buffer channel can accommodate displaced material without adversely affecting the flow properties of the finished tube product.

Figure 7:
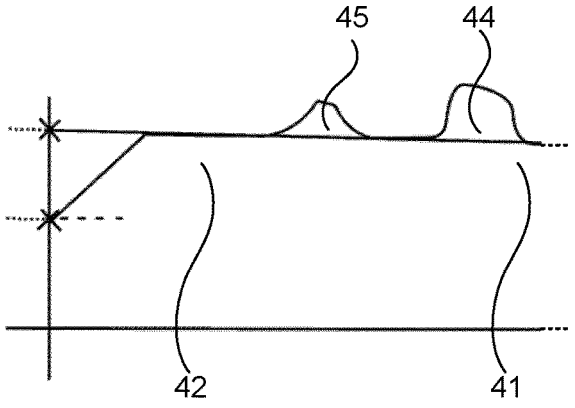
FIG. 7 schematically illustrates the edge of a strip which has been pre-formed by an embossing roll according to the present disclosure.

Further, if desired, the longitudinal side edges on each side of the metal strip, on the side of the metal strip directed toward the embossing roll, can be chamfered, as shown in FIG. 7 by being passed between a subsequent pair of rolls. This reduces the size of the interior weld bead and thus improves the performance of the finished tube.

DESCRIPTION OF EXAMPLE EMBODIMENTS

The present disclosure will now be described with reference to the accompanying drawings, in which preferred example embodiments of the disclosure are shown. The disclosure may, however, be embodied in other forms and should not be construed as limited to the herein disclosed embodiments. The disclosed embodiments are provided to fully convey the scope of the disclosure to the skilled person.

FIG. 1 is a schematic illustration of a set-up 20 for pre-forming a metal strip 40. The set-up includes an embossing station with an embossing roll 1 and an anvil 22, and an optional edge forming tool 30 comprising a pair of roll 31, 32. The strip 40 travels through the pre-forming tools in a travel direction T.

Figure 3C:
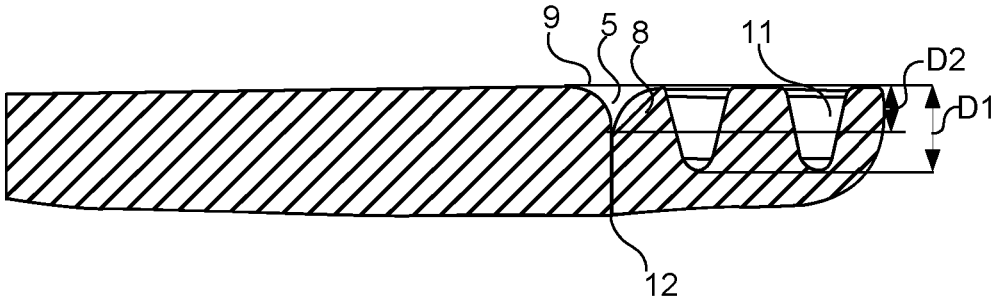
FIG. 3*c* is a cross-sectional view of the encircled detail shown in FIG. 3*b;*

FIG. 2 is an exploded perspective view of an example of an embossing roll according to the present disclosure, and FIG. 3*a* is a cross-sectional view of the same roll, and FIGS. 3*b-c* show details. The embossing roll 1 has a cylindrical surface 2, which comprises a central portion 3 having an embossing pattern 10 and side portions 4*a*, 4*b* arranged on each side of the central portion 3. The side portions 4*a*, 4*b* are free from embossing pattern as shown in FIGS. 3*b-c*. As shown in FIG. 3*c*, a circumferential buffer channel 5 is provided between the central portion and the side portions, along the cylindrical surface 2 of the embossing roll. Buffer channels 5 are provided on each side of the central portion 3. The cylindrical surface of the embossing roll has a total width W1, and the central portion has a width W2, which is 85-99% of the total width W1.

In the shown example, the central portion 3 of the embossing roll 1 is comprised of a central embossing pattern roll 6, and the side portions 4*a*,4*b* are comprised of side rolls 7*a*,7*b*. The side rolls are arranged on each side of the central embossing roll. The embossing pattern 10 on the central portion of the embossing roll comprises a plurality of elongated grooves 11 having a depth D1 and being arranged at an angle with respect to the direction of rotation of the embossing roll, said groove depth D1 of the embossing pattern preferably being below 0.35 mm. As shown in FIG. 3*c*, the cylindrical surfaces of the central embossing pattern roll pack 6 and the side rolls 7*a*,7*b* can have bevelled edges 8, 9 at the interface 12 between the central embossing pattern roll pack and the side rolls, so that the circumferential buffer channels 5 are formed at said interface by the bevelled edges of the central embossing pattern roll pack and the bevelled edges of the side rolls 7*a*,7*b*. As shown in FIGS. 3*a-c*, the cylindrical surfaces of the side portions 4*a*,4*b* are level with the cylindrical surface of the central portion 3 between the grooves.

The circumferential buffer channels 5 are formed by the bevelled edges of the central embossing pattern roll pack and the bevelled edges of the side rolls 7*a*,7*b* have a depth D2, which is less than the depth D1 of the embossing pattern grooves 11, preferably 50-70% of the depth D1 of the embossing pattern grooves.

Figure 4:
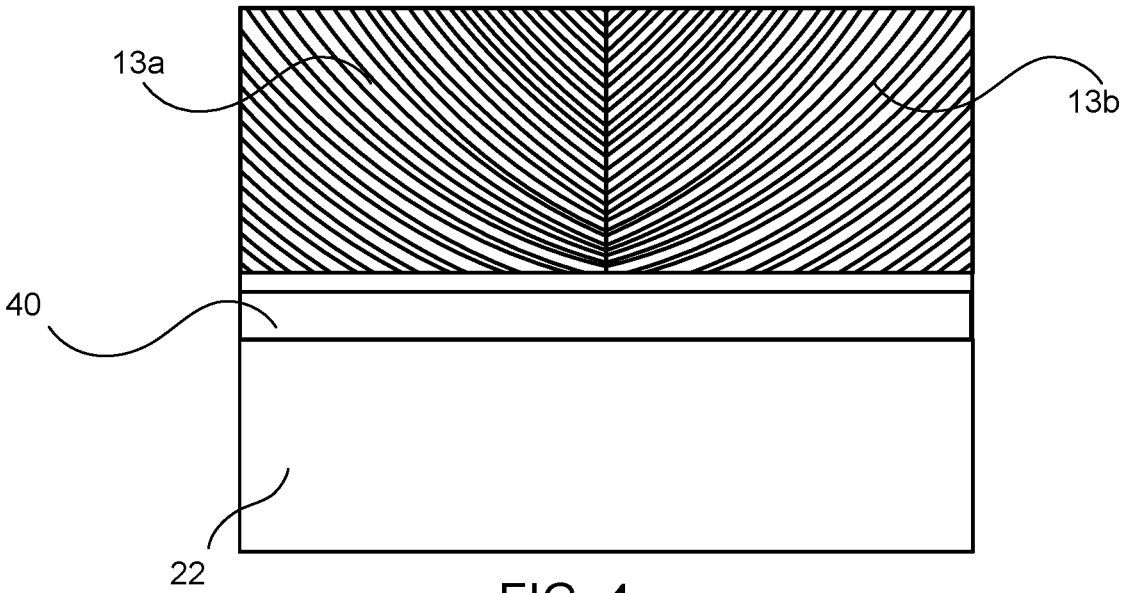
FIG. 4 schematically illustrates a detail of an embossing roll of an example according to the present disclosure.
Figure 5:
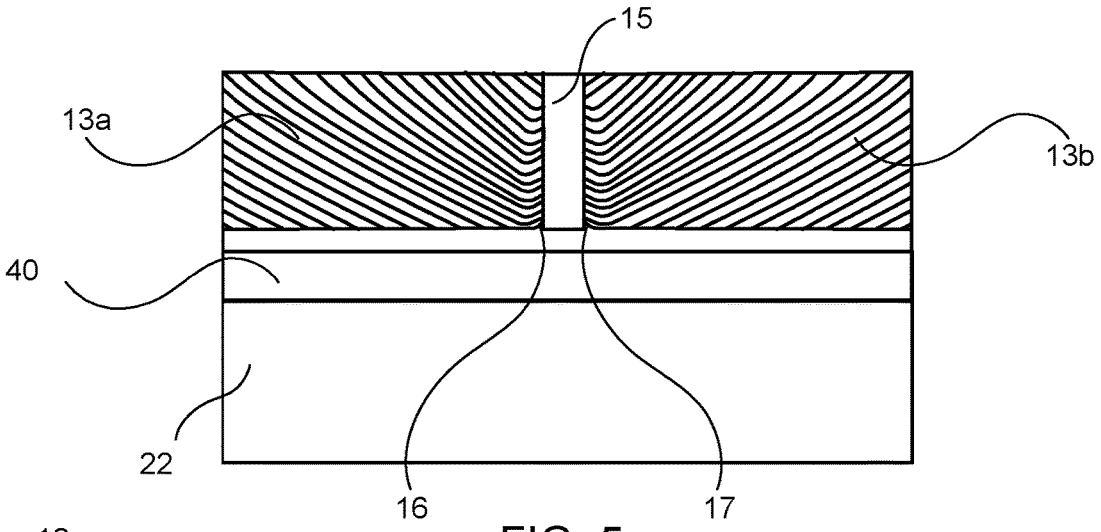
FIG. 5 schematically illustrates a detail of an embossing roll of another example according to the present disclosure.

The central embossing roll can be in the form of an embossing pattern roll pack, comprising multiple embossing pattern rolls. Thus, the central portion 3 of the embossing roll 1 can comprise an embossing pattern roll pack including one or more embossing pattern discs 13*a*, 13*b* with cylindrical embossing surfaces having the same or different embossing pattern provided thereon. FIG. 4 illustrates a detail of an embossing roll pack comprising two pattern rolls, the metal strip 40 to be embossed, and the anvil 22. In this case, the embossing pattern roll pack comprises two embossing pattern discs 13*a*, 13*b* each having an embossing pattern consisting of grooves arranged at an angle, but with mirroring patterns, which together form a herringbone pattern on the embossed strip. FIG. 5 illustrates a detail of an embossing roll pack comprising a smooth spacer ring 15 between the embossing pattern disc 13*a*,13*b*. In this case, the cylindrical surface of each spacer ring is level with the cylindrical surface of the central portion 3 between the grooves. As shown in FIG. 5, the embossing pattern discs 13*a*,13*b* and the smooth spacer ring 15 have bevelled edges 16,17 at the interface between them.

Figure 6:
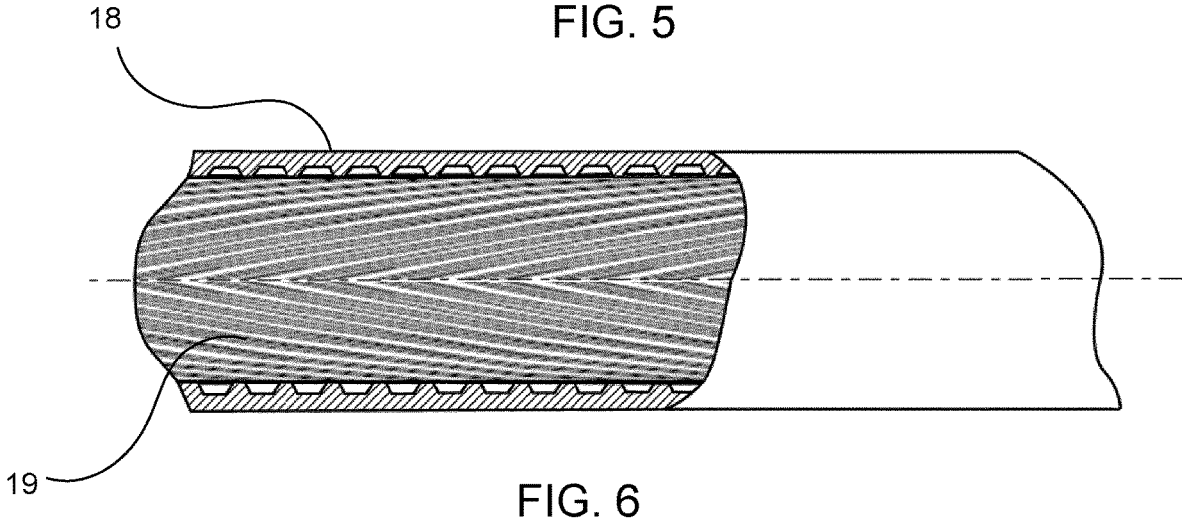
FIG. 6 shows a partly cross-sectional view of a tube having an interior embossed pattern.

FIG. 6 shows a partly cross-sectional view of a tube 18 having an interior embossed herringbone pattern 19.

FIG. 7 shows a cross-section of a portion of a finished pre-formed strip, which has been pre-formed by an embossing roll according to the present disclosure. The drawing shows how small dimple 45 is present at the interface between the non-patterned side portion 42 and the central portion 41 on which is present an embossing pattern comprising a plurality of protruding fins 44 (only one fin is shown in this drawing). The small dimple 45 is a result of the buffer channel (5 in FIG. 3*c*) provided on the embossing roll. The fins 44 correspond to the grooves 11 of the embossing pattern 10 on the embossing roll. The drawing also shows how surface of the side portion 42 is level with the bottom of the grooves created between the fins 44. Optionally, the outermost edge of the strip can be chamfered as shown in FIG. 7.

The person skilled in the art realizes that the present disclosure is not limited to the preferred embodiments described above. The person skilled in the art further realizes that modifications and variations are possible within the scope of the appended claims. Additionally, variations to the disclosed embodiments can be understood and effected by the skilled person in practicing the claimed disclosure, from a study of the drawings, the disclosure, and the appended claims.

The invention claimed is:

1. An embossing roll (1) having a cylindrical surface (2), wherein the cylindrical surface comprises a central portion (3) having an embossing pattern (10) and side portions (4*a*, 4*b*) arranged on each side of the central portion, which are free from embossing pattern, and wherein circumferential buffer channels (5) are provided on each side of the central portion (3), between the central portion (3) and the side portions (4*a*, 4*b*), along the cylindrical surface (2) of the embossing roll (1).

2. The embossing roll of claim 1, wherein the embossing pattern (10) on the central portion of the embossing roll comprises a plurality of elongated grooves (11) having a depth (D1) and being arranged at an angle with respect to the direction of rotation of the embossing roll.

3. The embossing roll of claim 1, wherein the central portion (3) of the embossing roll (1) is comprised of a central embossing pattern roll pack (6), and the side portions (4*a*, 4*b*) are comprised of side rolls (7*a*, 7*b*), said side rolls being arranged on each side of the central embossing roll pack, and wherein the central embossing pattern roll pack has a cylindrical surface forming the central portion (3) and the side rolls have cylindrical surfaces forming the side portions (4*a*, 4*b*).

4. The embossing roll of claim 3, wherein the cylindrical surfaces of the central embossing pattern roll pack (6) and the side rolls (7*a*, 7*b*) have bevelled edges (8, 9) at the interface (12) between the central embossing pattern roll pack and the side rolls, so that the circumferential buffer channels (5) are formed at said interface by the bevelled edges of the central embossing pattern roll pack and the bevelled edges of the side rolls (7*a*, 7*b*).

5. The embossing roll of claim 4, wherein the circumferential buffer channels (5) formed by the bevelled edges of the central embossing pattern roll pack and the bevelled edges of the side rolls (7*a*, 7*b*) have a depth (D2), which is less than the depth (D1) of the embossing pattern grooves (11).

6. The embossing roll of claim 4, wherein the circumferential buffer channels (5) formed by the bevelled edges of the central embossing pattern roll pack and the bevelled edges of the side rolls (7*a*, 7*b*) have a depth (D2), which is 50-70% of the depth (D1) of the embossing pattern grooves.

7. The embossing roll of claim 1, wherein the cylindrical surface of the embossing roll has a total width (W1) of 15 mm or more, and the central portion has a width (W2), which is 85-99% of the total width (W1).

8. The embossing roll of claim 1, wherein the central portion (3) of the embossing roll (1) comprises an embossing pattern roll pack (6) including one or more embossing pattern discs (13*a*, 13*b*) with cylindrical embossing surfaces having the same or different embossing pattern provided thereon.

9. The embossing roll of claim 8, wherein the embossing pattern roll pack (6) comprises two or more embossing pattern disc (13*a*, 13*b*) and a smooth spacer ring (15) between each embossing pattern disc (13*a*, 13*b*).

10. The embossing roll of claim 9, wherein the embossing pattern discs (13*a*, 13*b*) and the smooth spacer ring(s) (15) have bevelled edges (16, 17) at the interface between them.

11. The embossing roll of claim 8, wherein the embossing pattern discs (13*a*, 13*b*) have bevelled edges (16, 17) at the interface between them.

12. The embossing roll of claim 8, wherein the embossing pattern roll pack (6) comprises two or more embossing pattern disc (13*a*, 13*b*) and a smooth spacer ring (15) between each embossing pattern disc (13*a*, 13*b*), the cylindrical surface of each spacer ring being level with the cylindrical surface of the central portion (3) between the grooves.

13. The embossing roll of claim 1, wherein the embossing pattern (10) on the central portion of the embossing roll comprises a plurality of grooves (11) arranged in the cylindrical surface of the central portion (3), and wherein the cylindrical surface of each side portion (4*a*, 4*b*) is level with the cylindrical surface of the central portion (3) between the grooves.

14. The embossing roll of claim 1, wherein the embossing pattern (10) on the central portion of the embossing roll comprises a plurality of elongated grooves (11) having a depth (D1) and being arranged at an angle with respect to the direction of rotation of the embossing roll, said groove depth (D1) of the embossing pattern being below 0.35 mm.

* * * * *